US008505611B2

(12) United States Patent
Otsuka

(10) Patent No.: US 8,505,611 B2
(45) Date of Patent: Aug. 13, 2013

(54) TWIN ROLL CONTINUOUS CASTER

(75) Inventor: Hiroyuki Otsuka, Yokohama (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 13/157,600

(22) Filed: Jun. 10, 2011

(65) Prior Publication Data

US 2012/0090804 A1 Apr. 19, 2012

(51) Int. Cl.
*B22D 11/06* (2006.01)
*B22D 11/124* (2006.01)

(52) U.S. Cl.
USPC ..... 164/428; 164/442; 164/443; 164/414

(58) Field of Classification Search
USPC ..... 164/428, 480, 442, 448, 485, 443, 164/455, 414
See application file for complete search history.

(56) References Cited

U.S. PATENT DOCUMENTS

| | | | | |
|---|---|---|---|---|
| 4,440,012 | A | 4/1984 | Feldmann et al. | |
| 4,519,233 | A | 5/1985 | Feldmann et al. | |
| 4,781,051 | A | 11/1988 | Schultes et al. | |
| 4,798,074 | A | 1/1989 | Feldmann et al. | |
| 4,800,742 | A | 1/1989 | Feldmann et al. | |
| 4,881,396 | A | 11/1989 | Seidel et al. | |
| 4,955,221 | A | 9/1990 | Feldmann et al. | |
| 5,560,421 | A * | 10/1996 | Tanaka et al. | 164/480 |
| 5,626,183 | A | 5/1997 | Romanowski et al. | |
| 5,642,772 | A | 7/1997 | Charpentier et al. | |
| 5,651,281 | A | 7/1997 | Seidel | |
| 5,697,244 | A | 12/1997 | Seidel | |
| 5,887,644 | A | 3/1999 | Akiyoshi et al. | |
| 5,943,896 | A | 8/1999 | Rosenthal et al. | |
| 5,964,116 | A | 10/1999 | Bode et al. | |
| 5,970,765 | A | 10/1999 | Seidel | |
| 6,038,906 | A | 3/2000 | Hartung et al. | |
| 6,138,487 | A | 10/2000 | Hartung et al. | |
| 6,241,002 | B1 * | 6/2001 | Russell et al. | 164/428 |
| 6,619,375 | B2 | 9/2003 | Hohenbichler et al. | |
| 7,059,163 | B2 | 6/2006 | Hartung et al. | |
| 2004/0035549 | A1 | 2/2004 | Eberwein | |

FOREIGN PATENT DOCUMENTS

| | | |
|---|---|---|
| EP | 0260835 | 3/1988 |
| EP | 0688620 | 12/1995 |
| GB | 2130131 | 5/1984 |
| WO | 98/55251 | 12/1998 |

OTHER PUBLICATIONS

International Search Report and Written Opinion in PCT/AU2009/000997, dated 2009-09-04.
Excerpts from Japanese Patent Application JP 2011-506098 A machine translated by Japanese Patent Office, dated May 19, 2011.

* cited by examiner

*Primary Examiner* — Kevin P Kerns
*Assistant Examiner* — Steven Ha
(74) *Attorney, Agent, or Firm* — Hahn, Loeser & Parks LLP; Arland T. Stein

(57) ABSTRACT

In a twin roll continuous caster, the contour of the strip cast is controlled during casting by regulating the temperature of temperature-regulating medium circulated through temperature-regulating passages in the casting rolls spaced inward of cooling passages in the circumferential portion adjacent the casting surfaces. The temperature-regulating passages may be positioned in the circumferential portion or in the inner portion of the casting rolls, or both.

15 Claims, 11 Drawing Sheets

TWIN ROLL CONTINUOUS CASTER

This Application claims priority to and the benefit of Japanese patent application serial number 10 P 00711 filed on Oct. 18, 2010. The disclosure of which is herein incorporated by reference.

BACKGROUND AND SUMMARY OF THE INVENTION

This invention relates to a twin roll continuous caster, and more particularly to a twin roll continuous caster that enables variation of the temperature of the casting rolls and the adjustment of the contour of the rolls during casting. A twin roll caster provides for continuous casting of thin metal strip from molten metal. The pair of casting rolls are laterally positioned to form a nip between the rolls and support a casting pool of molten metal on the casting rolls immediately above the nip. The molten metal may be poured from a ladle into a smaller vessel, or series of smaller vessels, from which it flows through a metal delivery nozzle located above the nip, forming the casting pool of molten metal extending the length of the nip. This casting pool is usually confined between side plates, or side dams, held in sliding engagement with the end surfaces of the casting rolls so as to restrain the two ends of the casting pool against overflow. The molten metal, supported on the counter-rotating casting rolls, is cooled on the casting surfaces of the casting rolls to form shells that are brought together at the nip between the casting rolls to form thin metal strip that is cast downwardly from the nip.

The twin roll continuous caster may be capable of continuously producing cast strip from molten steel through a sequence of ladles. Pouring the molten metal from the ladle into smaller vessels before flowing through the metal delivery nozzle enables the exchange of an empty ladle with a full ladle without interrupting the production of cast strip.

Specifically, the twin roll continuous caster cools the molten metal in the melt pool adjacent the casting surfaces of the casting rolls to form shells on the casting surface, which are brought together at the nip and continuously cast solidified thin strip downwardly from the nip between the casting rolls. To cool the casting surface of the casting rolls, cooling water is passed through the interiors of the casting rolls. Because the casting surfaces of the rolls are in contact with molten metal at, for example, a temperature of 1600° C., the temperature of the casting rolls are regulated to provide a desired temperature and heat flux from the molten metal in contact with the casting surfaces of the casting rolls. Typically, the casting rolls are maintained at a temperature of no more than approximately 400° C.

In casting thin strip by a twin roll continuous caster, the predictability of the crown in the casting surfaces of the casting rolls during a casting campaign is a difficulty. The crown of the casting surfaces of the casting rolls determines the thickness profile, i.e., the cross-sectional shape, of thin cast strip produced by the twin roll caster. Casting rolls with convex (i.e., positive crown) casting surfaces produce cast strip with negative (depressed) cross-sectional profile, and casting rolls with concave (i.e., negative crown) casting surfaces produce cast strip with a positive (i.e., raised) cross-sectional profile. The casting rolls are generally formed of copper or copper alloy with internal passages for circulation of cooling water and usually coated with chromium or nickel to form the casting surfaces. The casting rolls undergo substantial thermal deformation with exposure to the molten metal.

A problem exists where the contours of the casting rolls are altered axially and radially by the heat of the molten metal. The change in contour of the casting rolls, particularly radially, is manifested in the thickness profile of the thin cast strip that is cast. Hence, hitherto, the extent of deformation of the casting rolls during hot operation has had to be predicted prior to casting. Negative crowns are formed in the casting rolls, before casting while the rolls are cold, to provide a desired cast strip thickness profile taking account of the predicted extent of deformation of the casting rolls during the casting campaign to provide flat thin cast strip or thin cast strip with a slight crown, as desired. However, the crown shape of the casting surfaces during casting conditions is difficult to predict due to the changes in the temperature of the molten metal supplied to the casting pool, changes in the speed of casting, even slight changes in the composition of the metal and other variables. Therefore, the dimensions of the negative crown applied to the casting rolls when cold may not be appropriate during the entire casting campaign.

The variation in temperature and the temperature gradient across the casting rolls causes complex deformations in the cast strip in both the radial and axial directions. The thickness profile of the thin cast strip is shaped by the casting rolls, and especially by the variation of the contour of the edge portions of the strip. The variation in the thickness of the edge portions of the thin cast strip impacts the quality of the thin cast strip and also the hot rolling process performed after casting.

Also, the variation of the thickness profile of the thin cast strip may be the cause of functional difficulties with the pinch rolls designed to limit the deviation to left and right of the strip during rolling. Alternatively, or in addition, the variation of the thickness profile of the thin cast strip may be the cause of wrinkling and cracking of the strip after rolling.

The twin roll continuous casters of the prior art also contemplated alterations to the operating conditions during the casting campaign, e.g., by changing the casting rate or the volume of molten metal in the casting pool above the nip of the casting rolls. However, controlling and adjusting changes in the contours of the casting rolls during normal casting operation of the twin roll continuous caster was difficult at best. Any change in the casting rate or volume of molten metal in the casting pool results in a corresponding change in the strip profile. Furthermore, such changes in casting rate and volume of molten metal in the casting pool also change other casting parameters, such as strip gauge control, and therefore cannot readily be altered.

As described in Japanese Patent No. JP7-88599, the thermal deformation of the casting rolls of a twin roll continuous caster was found to depend on the temperature of the casting rolls, and therefore the contour of the casting rolls could be adjusted by altering the temperature of the casting rolls through external action. For example, a casting roll contour measuring instrument could be used to measure the extent of the casting roll crowns, or a cast strip profile measuring instrument could be employed to measure the cast strip crown. This data can be used to modify the output of a casting roll heating/cooling apparatus, and thereby regulate the surface contour of the casting rolls.

As described in Japanese Patent No. JP7-276004, the heat flux from the molten metal to the casting rolls could be varied and the cast strip crown and thickness could thereby be controlled. The device attempts to control the cast strip crown and thickness during casting by varying the heat flux from the molten metal to the casting rolls by employing sealing gas above the casting pool and adjusting the gas delivery temperature and/or the gas mixing proportions of the sealing gas. To achieve this temperature change, large amounts of sealing gas are needed to be delivered and adjusted. An elaborate apparatus was needed for that purpose since the sealing gas had low thermal conductivity making it difficult to alter the contour of the casting rolls evenly and consistently.

Moreover, in the prior twin roll casters, the cylindrical body of the casting roll typically included a main roll shaft that could be made to be watertight, and have pressurized tubes connected through the main roll shaft to the interior of a circumferential portion of the casting roll body. The circumferential portion of the cylindrical body was typically a watertight copper sleeve with internal cooling tubes in thermal engagement with the outer circumference of the circumferential portion, and preshaped to impart a concavely shaped reverse crown to the central portion of the casting roll to make possible the hydrostatic expansion and contraction of the circumferential body portion varying the contour of the casting roll through liquid pressure. Japanese Patent No. JP7-256401 discloses adjusting the liquid pressure delivered to the casting rolls in such a manner as to improve the extent of expansion (amount of reverse crown) of the casting rolls. However, an elaborate, large hydraulic device at high pressure was required in order to control the crown by the liquid pressure in this manner. Moreover, the contours of the casting rolls change greatly if the liquid pressure falls (for whatever reason) because the contours of the casting rolls are controlled by the liquid pressure.

The present invention provides a twin roll continuous caster that is able to alter the temperature distribution over the casting surfaces of the casting rolls and adjust the contour of the casting rolls during casting operations.

The twin roll continuous caster disclosed comprises a pair of casting rolls laterally positioned to form a nip there between, adapted to support a molten casting pool above the nip, and to produce a thin cast strip downwardly from the nip between the casting rolls. The casting rolls comprise a circumferential portion having a plurality of circumferential cooling passages, adapted to carry cooling liquid, adjacent a circumferential casting surface, and a temperature-regulating passage or passages, adapted to carry temperature-regulating liquid medium, spaced inward of the cooling passages.

The twin roll caster also comprises a cooling liquid circuit. The first cooling liquid circuit is adapted to circulate cooling liquid that has passed through the casting rolls from the outlets in the cooling passages to a cooler, such as a cooling tower, for cooling, and circulate the cooled cooling liquid from the cooler to the inlet in the first end portion of the cooling passages. A flow rate regulator is adapted to regulate the flow rate through the cooling liquid circuits.

The temperature-regulating passages are placed inwardly of the cooling liquid passages in the casting rolls. A temperature-regulating medium, typically water, from a supply unit is circulated to the temperature-regulating passages through inlets in said temperature-regulating passages and discharged through outlets in the temperature-regulating passages and circulated back to the supply unit. The temperature-regulating medium enables extensive deformation of the circumferential portion of the casting rolls, which in turn allows control of the contour of the casting rolls to be regulated during casting operations. The deformation of and contour of the casting surfaces of the casting rolls and in turn the profile of the cast strip is regulated by controlling the temperature and flow-rate of the temperature-regulating medium, which is supplied to the temperature-regulating passages of the casting rolls. This twin roll caster improves profile quality and yield of the thin cast strip that is formed with the casting rolls.

The temperature-regulating medium supply unit may further comprise of a temperature regulator to regulate the temperature of the temperature-regulating medium circulating through the temperature-regulating passages of the casting rolls.

Also, the twin roll continuous caster may further comprise a thermometer adapted to measure the temperature of the temperature-regulating medium to produce an output signal corresponding to the measured temperature of the temperature-regulating medium. Typically the thermometer is located at or near the outlets in the temperature-regulating passages. A profile detector may also be adapted to measure the profile of the thin cast strip, and produce an output signal corresponding to the measured profile of the thin cast strip. A controller may also be adapted to receive the output signal from the thermometer, the output signal from the profile detector and a target profile value of the thin cast strip, and regulate the temperature of the temperature regulating medium to produce thin cast strip of a desired profile. The profile detector may be replaced or enhanced by a contour detector adapted to measure the contour of the casting surface of the casting rolls, and produce a signal as an output corresponding to the measured contour value that is input to the controller. By use of a contour value input signal, the controller may be able to more accurately regulate the temperature of the temperature regulating medium by the temperature regulator.

The twin roll caster may also comprise a first temperature-regulating circuit of passages to circulate the temperature-regulating medium through the casting rolls and discharge the temperature-regulating medium at elevated temperature from the outlets in said temperature-regulating passages and circulate it to a cooler unit to cool the temperature-regulating medium. The temperature regulator measures temperature of the temperature-regulating medium circulated to the inlets of said temperature-regulating passages. A second temperature-regulating circuit of passages are also adapted to circulate temperature-regulating medium at elevated temperature discharged from the outlets in the temperature-regulating passages directly to said inlets of the temperature-regulating passages, and a volume flow rate regulator adapted to regulate the temperature and flow rate distributions of temperature-regulating medium circulated liquid between said first and second temperature-regulating passages.

Alternatively or in addition, the inner portion of the casting rolls may be adapted to provide one or more temperature-regulating passages to circulate the temperature-regulating medium. The inner portion has a first end portion and a second end portion. Through a first temperature-regulating circuit, the first end portion of the inner portion has an inlet adapted to receive a supply of temperature-regulating medium from the supply unit and a second end portion has an outlet adapted to discharge the temperature-regulating medium and circulate the same to a cooling unit of the supply unit. In addition, the inlet and outlet of the temperature-regulating passages may be connected through a second temperature-regulating circuit adapted to direct temperature-regulating medium from the outlet to the inlet. In any case, the temperature-regulating medium supply unit may include a temperature regulator adapted to regulate the temperature of the temperature-regulating medium. A flow-rate regulator is also provided for regulating the flow rate of the temperature-regulating medium through the first and second temperature-regulating circuits, as well as the flow rate distribution between the first and second temperature-regulating circuits.

The same or additional controller may be adapted to function with the inner portion of the casting rolls. In any case the controller may be adapted to regulate the flow rate of the temperature-regulating medium by a volume flow-rate regulator, and adapted to regulate the flow-rate distributions of the temperature-regulating medium flowing through the first and second temperature-regulating circuits by the same or a second volume flow-rate regulator. The controller may be further adapted to control the temperature of the temperature-regulating medium by a temperature regulator to regulate the temperature of the liquid medium flowing through the inner portion of the casting roll. One of ordinary skill in the art would appreciate and recognize that the second controller may be integrated into the same unit as the controller for regulating the temperature-regulating medium used in the outer circumferential portion of the casting rolls, if provided.

DETAILED DESCRIPTION OF THE DRAWINGS

Figure 2:
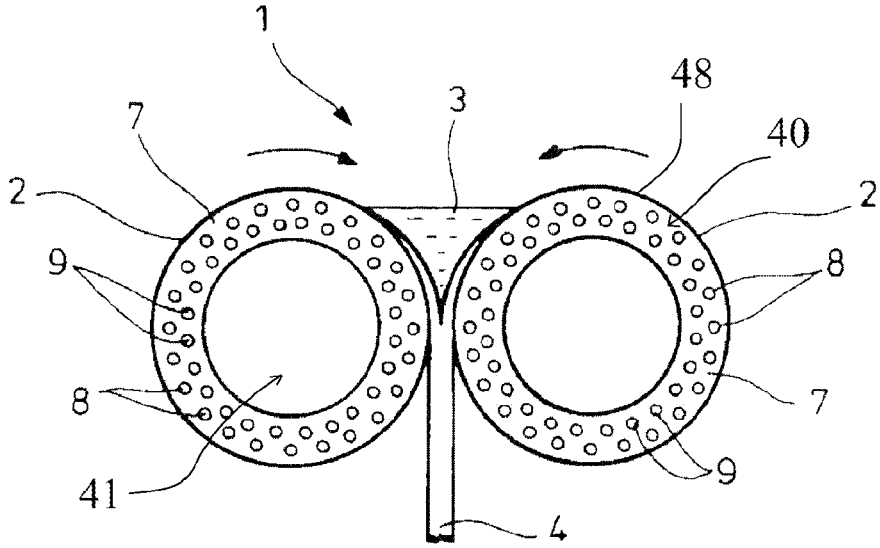
FIG. 2 is a side cross-sectional representation of a twin roll continuous caster in accordance with the invention.
Figure 3:
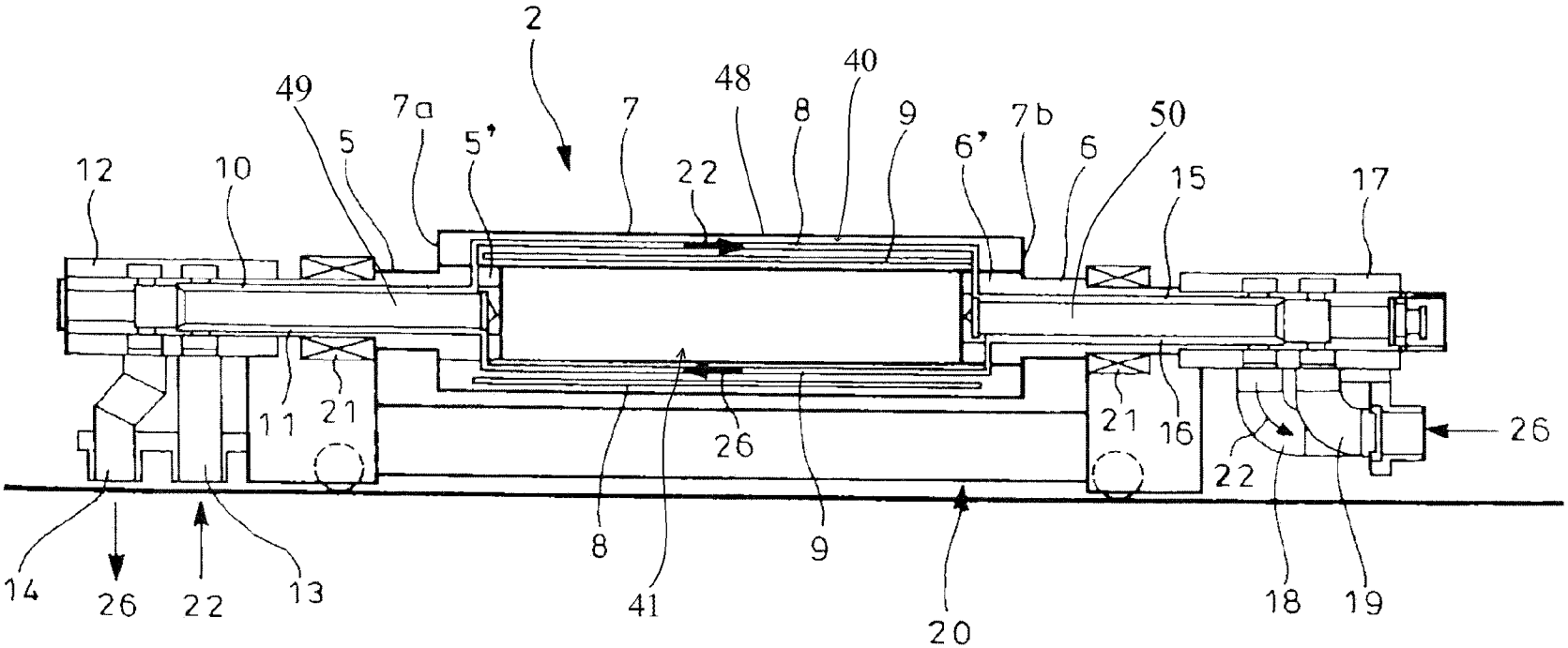
FIG. 3 is a front cross-sectional view of a casting roll provided in the twin roll continuous caster represented by FIG. 2.
Figure 4:
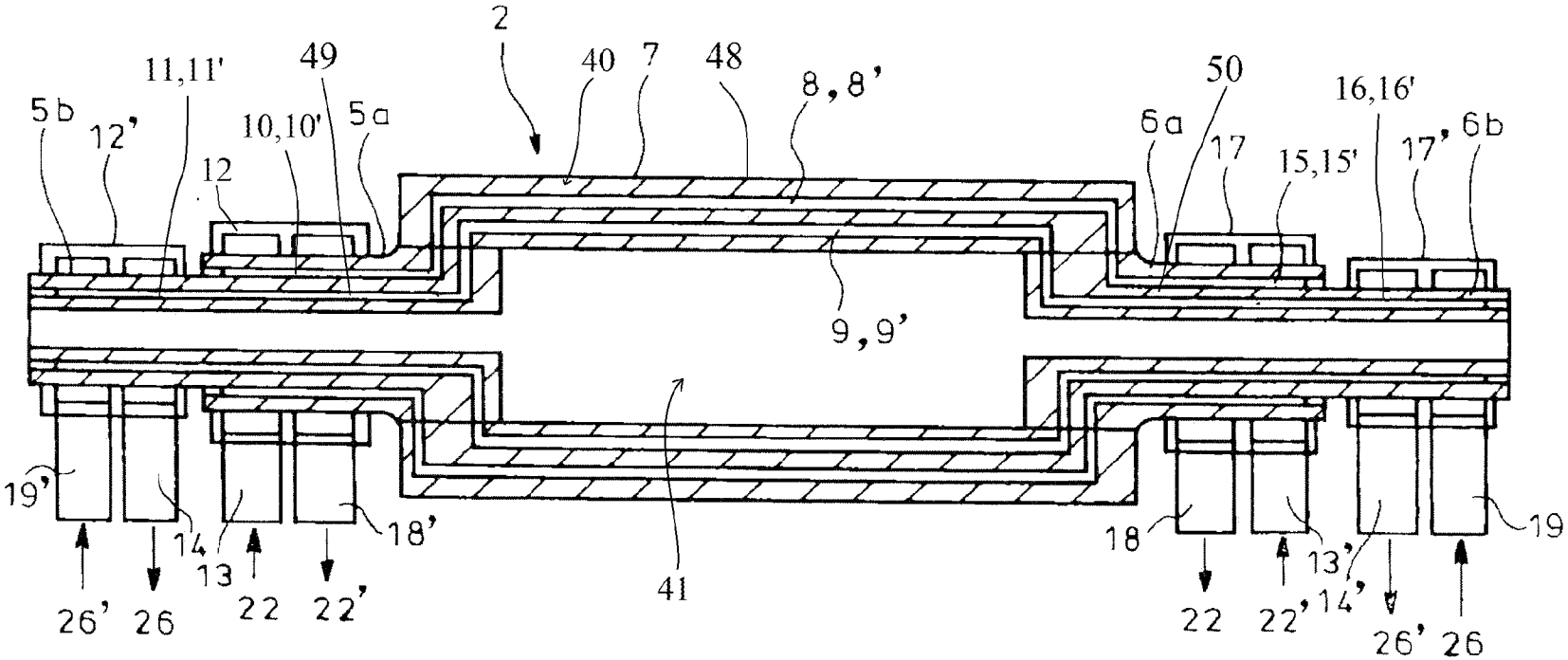
FIG. 4 is a front cross-sectional block diagram of a casting roll provided in the twin roll continuous caster of FIG. 2.

Referencing FIGS. 2, 3 and 4, a twin roll continuous caster 1 is disclosed having a pair of counter-rotating casting rolls 2 and 2' laterally positioned to form a nip there between and adapted to support a molten casting pool 3 formed above the nip along the length of casting rolls 2 and 2'. The casting rolls 2 and 2' cool the molten metal forming shells on the casting surface 48 of the casting rolls 2 and 2', as the casting rolls 2 and 2' counter-rotate, and the shells come together at the nip to form thin cast strip 4 cast downwardly from the nip of the casting rolls 2 and 2'.

The casting rolls 2 and 2' are each comprised of an outer circumferential portion 40 and an inner portion 41, each circumferential portion 40 is typically comprised of a sleeve 7 of copper or copper alloy, the outer surface of (usually coated with, for example, chromium alloy) which is the casting surfaces 48 of the casting roll 2 or 2'. A plurality of cooling passages 8,8' are provided in each circumferential portion 40 adjacent a circumferential casting surface 48 radially inwardly in the sleeve 7. The cooling parallel passages 8 and 8' are positioned alternately around each circumferential portion 40, and are arranged so that cooling liquid 8 circulates in opposite directions through passages 8 and 8' to provide for more even responsive temperature distribution by the cooling liquid 8 around the casting roll. A plurality of circumferential temperature-regulating passages 9,9' are positioned circumferentially, spaced inward of the cooling passages 8,8' disposed around each circumferential portion 40. As with cooling passages 8,8', the temperature-regulating passages 9 and 9' are positioned alternatively in parallel arrangement around each circumferential portion 40, with temperature-regulating medium 26 circulating in opposite directions through regulating passages 9 and 9' to provide for more even responsive temperature distribution by the temperature-regulating medium 26 around the casting roll.

The cooling liquid 22 may be input to the cooling passages 8 and 8' and discharged from the cooling passages 8 and 8' through the same end portion or opposite end portions of the casting roll 2 or 2'; and the temperature-regulating medium 26 may be input to the temperature-regulating passages 9 and 9' and discharged from the temperature-regulating passages 9 and 9' through the same end portion or opposite end portions of the casting rolls 2 or 2'. Alternatively, both cooling passages 8 and 8' and temperature-regulating passages 9 and 9' may input to the casting rolls 2 or 2' from opposite end portions of each casting roll 2 and 2' as illustrated in FIGS. 3 and 4 and explained in detail below.

Casting rolls 2 and 2' are each comprised of a first shaft 5 and a second shaft 6 which axially support the casting roll, and have a first end portion 49 and a second end portion 50. To circulate cooling liquid 22 through cooling passages 8 in the casting rolls 2 or 2', the first shaft 5 and second shaft 6 have annular passages 10 and 15, respectively, having inlet 13 in first end portion 49 through rotary joint 12 and outlet 18 in second end portion 50 through rotary joint 17, respectively; and to circulate cooling liquid 22' through cooling passages 8' in the casting rolls 2 or 2', the second shaft 6 and first shaft 5 have annular passages 15' and 10' having inlet 13' in second end portion 50 through rotary joint 17 and outlet 18' in first portion 49 through rotary joint 12. To circulate temperature-regulating medium 26 through temperature-regulating passages 9 in casting rolls 2 or 2', the second shaft 6 and first shaft 5 have annular passages 16 and 11, respectively, having inlet 19 in second end portion 50 through rotary joint 17' and outlet 14 in the first portion 49 through rotary joint 12'; and to circulate temperature-regulating medium 26' through temperature-regulating passages 9' in casting rolls 2 or 2', the first shaft 5 and second shaft 6 have annular passages 11' and 16', respectively, having inlet 19' in first end portion 49 through rotary joint 12' and outlet 14' in the second portion 50 through rotary joint 17', respectively. FIG. 3 shows a carriage 20 that supports the casting rolls 2 by the bearings 21, by which the casting rolls are supported and rotated during casting operation. Carriage 20 is adapted to travel axially to assist in the process of positioning the casting rolls 2 for casting.

Figure 1:
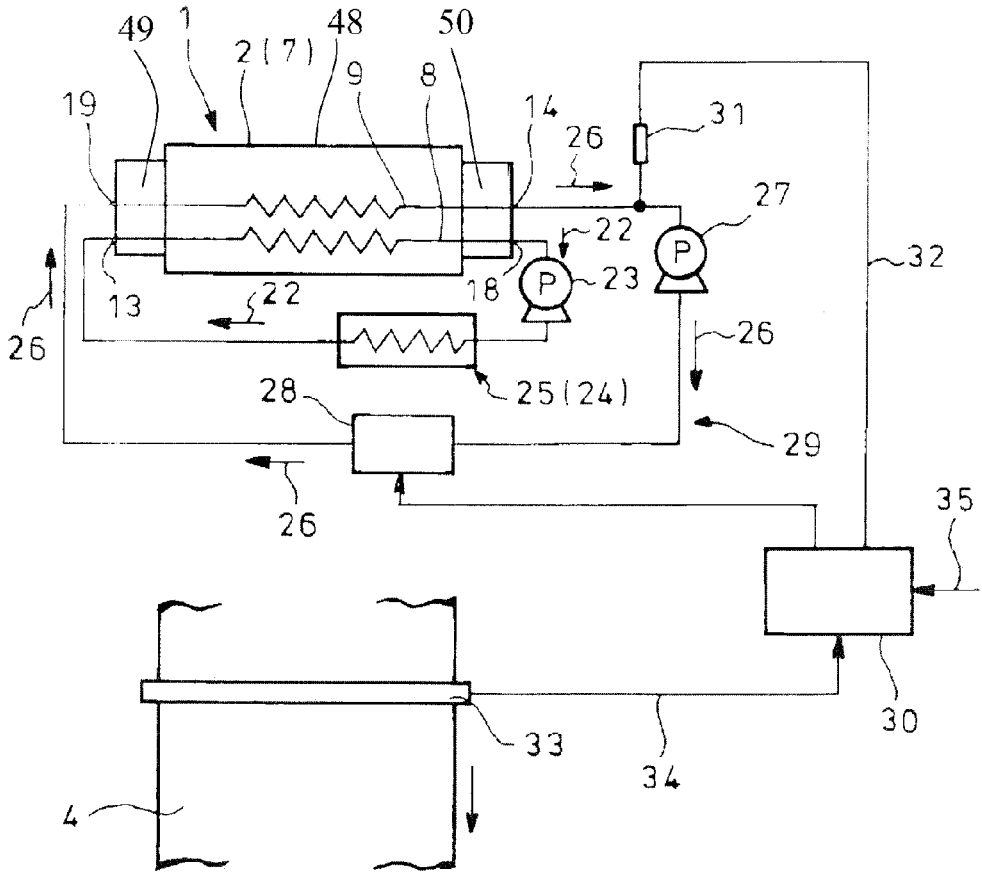
FIG. 1 is a block diagram representing a twin roll continuous caster system in accordance with the invention.

FIG. 1 is a block diagram representing the twin roll continuous caster 1 in accordance with the disclosed invention. The casting rolls 2 can be cooled by circulating the cooling liquid 22 to the cooling passages 8 through the inlet 13 by pump 23. The cooling liquid 22 is heated in the casting rolls 2 during a casting operation (heated by the molten metal) and then discharged from the cooling passages 8 through outlet 18 at the second end portion 50 of the casting roll 2. From there, the cooling liquid is circulated to the cooler 25, adapted to cool the cooling liquid 22, and then circulated back to the inlet 13 of the cooling passages 8. The cooler 25 typically comprises a cooling tower 24. Consequently, the casting rolls 2 are protected by cooling of the cooling liquid 22. During the casting campaign, the temperature of the circumferential casting surface 48 of the casting rolls 2 that is in contact with the molten metal, which may be at a temperature of 1600° C., is maintained typically at not more than approximately 400° C. A similar circulation of cooling liquid 22' may be provided for circulating through cooling passages 8'.

The temperature of the interior of the circumferential portions 40 may be regulated by circulating the temperature-regulating medium 26 through the temperature-regulating passages 9 from the temperature-regulating medium supply unit 29 by pump 27. The temperature-regulating medium 26 flows from the inlet 19 in the first end portion 49 of the casting roll 2, flows through the temperature-regulating passages 9, and is discharged from the temperature-regulating passages 9 through outlet 14 in the second end portion 50 of the casting roll 2. A temperature regulator 28 is adapted to regulate the temperature of the temperature-regulating medium 26 during circulation. From supply unit 29, the temperature regulating medium 26 is circulated back to inlet 19 of the temperature-regulating passages 9. A similar circulation of temperature-regulating medium 26' may be provided for circulating through temperature-regulating passages 9'

Figure 5:
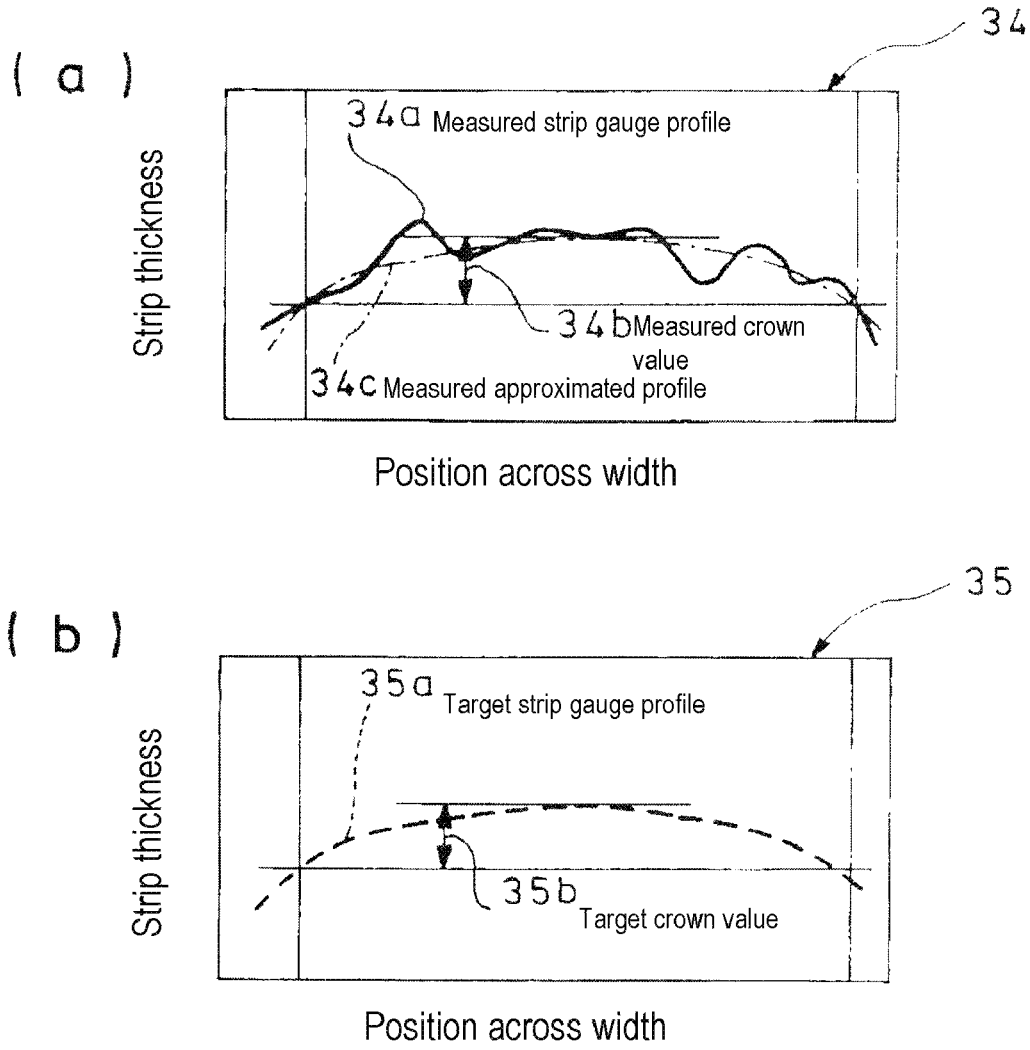
FIG. 5 (*a*) is a graph showing an example of the profile detection values of the strip thickness, and (*b*) is a graph showing an example of the target profile value of the strip thickness.

The twin roll continuous caster 1 of FIG. 1 may have a thermometer 30, adapted to measure the temperature of the temperature-regulating medium 26, typically positioned near the exits the temperature-regulating passages 9 at outlets 14, and to produce an output signal 32 corresponding to the measured temperature. The twin roll continuous caster 1 may further comprise a profile detector 33 adapted to detect the profile of the thin cast strip 4, and to produce an output signal 34 corresponding to the measured profile of the thin cast strip 4. Alternatively, the profile detector 33 may be replaced or enhanced by a contour detector (not shown) adapted to detect the contour of the casting surface 48 of the casting rolls 2, and to produce an output signal corresponding to the measured contour of the casting surface 48 of the casting rolls 2. Further, a controller 30 is provided to receive as inputs the output signal 32 from the thermometer 31, the output signal 34 (relating to measured strip gauge profile 34*a* and/or the measured crown value 34*b* shown in FIG. 5 (*a*)) from the profile detector 33 and/or the output signal from the contour detector, and a target profile value 35 of the thin cast strip 4. The profile detector 33 may be comprised of an x-ray emitter and an x-ray detector capable of measuring the x-ray energy absorbed and/or deflected by the thin cast strip 4 as it passes through the profile detector 33. FIG. 5 (*a*) shows the measured strip gauge 34*a*, the measured crown value 34*b*, and the measured approximate profile 34*c*. FIG. 5 (*b*) shows the target profile values 35 comprising the target strip gauge profile 35*a* and target crown value 35*b*, which may also be input to the controller 30.

To obtain the desired strip profile, the controller 30 may alter the contour of the casting rolls 2 and 2' by regulating the temperature of temperature-regulating medium 26,26' circulated to the temperature-regulating passages 9,9' by use of regulator 28. The temperature-regulating medium 26 enables extensive deformation of the circumferential portion of the casting rolls, which in turn allows control of the contour of the casting rolls 2,2' to be regulated during casting operations. The deformation of and contour of the casting surfaces 48 of the casting rolls 2,2' and in turn the profile of the cast strip 4 is regulated by controlling the temperature and flow-rate of the temperature-regulating medium 26, which is supplied to the temperature-regulating passages 9,9' of the casting rolls 2,2'. The controller 30 regulates the temperature on the basis of (i) the detected temperature 32 from thermometer 31, (ii) the detected profile value 34 of the thin cast strip 4 from the profile detector 33 (and/or the contour value of the casting rolls 2 from the contour detector), and (iii) the target values 35 to produce thin cast strip 4 of a desired profile. Referring to FIG. 4, the first shaft 5 of the casting rolls 2,2', may be a double axle assembly with an outer annulus 5*a* and an inner annulus 5*b* and the second shaft 6 may also being a double axle assembly with an outer annulus 6*a* and an inner annulus 6*b*. Rotary joints 12 and 12', and 17 and 17' being provided connected to the annulus 5*a* and 5*b*, and 6*a* and 6*b*, respectively. Cooling liquid 22 may be supplied through the rotary joints 12 to annular passages 10 (annulus 5*a*) from the inlets 13, in the first end portion 49 of the casting rolls 2,2' into cooling passages 8. Cooling liquid 22 then circulates through each alternate cooling passage 8, then flows through the annular passages 15 (annulus 6*a*) and is discharged from the outlets 18, in the second end portion 50 of the casting rolls 2,2', through the rotary joints 17. Further, cooling liquid 22 may be circulated to the annular passages 15' (annulus 6a) from the inlets 13', in the second end portion 50 of casting rolls 2,2', through the rotary joints 17. Cooling liquid 22' may then circulate through alternate cooling passages 8', and then flow through annular passages 10', (annulus 5*a*) to be discharged from the outlets 18', in the first end portion 49 of casting rolls 2,2', through rotary joints 12. Consequently, the cooling liquid 22 flows through the cooling passages 8 and the cooling liquid 22 flows through the cooling passages 8' in opposed directions. Alternatively, the cooling liquid 22 and 22' in the cooling passages 8 and 8', respectively, may flow in the same direction.

Temperature-regulating medium 26 may be circulated through annular passages 16 (annulus 6*b*) from the inlet 19 in the second end portion 50 of the casting rolls 2,2', through the rotary joints 17'. Temperature-regulating medium 26 may then be circulated through alternate temperature-regulating passage 9 and through annular passages 11 (annulus 5*b*) to discharge from the outlets 14 in the first end portion 49 of the casting rolls 2,2' through rotary joints 12'. Further, temperature-regulating medium 26' may be circulated to the annulus passages 11' (annulus 5*b*) from the inlets 19' in the first end portion 49 of the casting rolls 2,2' through rotary joints 12'. Temperature-regulating medium 26' may then flow through alternate temperature-regulating passage 9' and then through the annulus passages 16' (annulus 6*b*) to discharge from the outlets 14' in the second end portion 50 of the casting rolls 2,2' through rotary joints 17'. Consequently, the temperature-regulating medium 26 that flows through the temperature-regulating passages 9 and the temperature-regulating medium 26' that flows through the temperature-regulating passages 9' form opposing flows through alternate passages, inhibiting the development of longitudinal temperature contours in the casting rolls 2. Alternatively, the temperature-regulating medium 26 and 26' in the temperature-regulating passages 9 and 9', respectively, may flow in the same direction.

FIG. 3 shows the cooling liquid 22 that flows through the cooling passages 8 of the casting rolls 2, and the temperature-regulating medium 26 that flows through the temperature-regulating passages 9 of the casting rolls 2, flowing in opposed directions. Alternatively, the cooling liquid 22 and the temperature-regulating medium 26 may also circulate in the same direction, as shown in FIG. 1. Similar circulation of cooling liquid 22' and temperature-regulating medium 26' may be provided circulating through cooling passages 8' and temperature-regulating passages 9', respectively, having the same or opposite flow directions.

Figure 6:
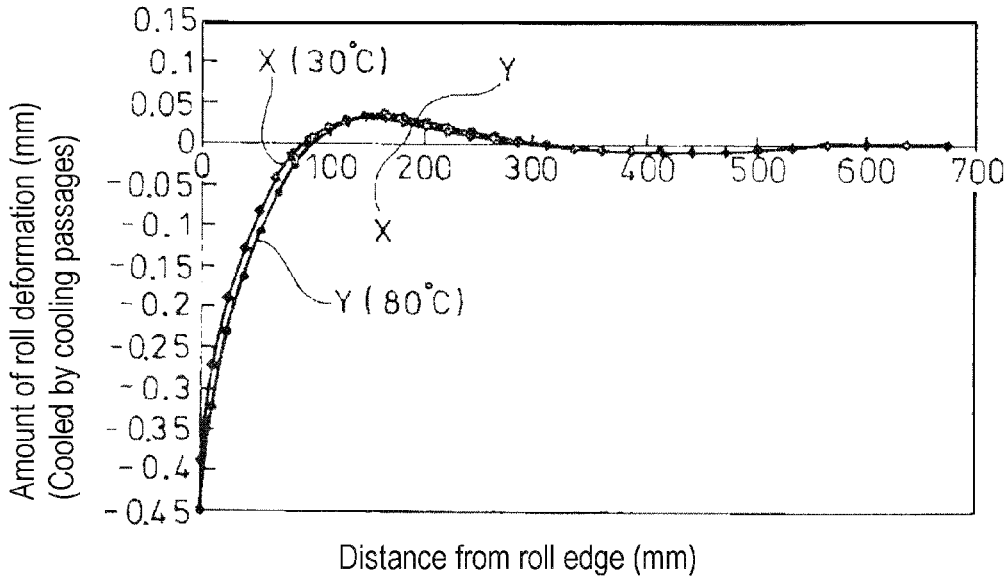
FIG. 6 is a graph showing the amount of deformation of a casting roll cooled by cooling liquid circulated through the cooling passages.

We conducted experiments to determine the amount of radial deformation in the casting rolls 2,2' with distance from the casting roll edge, when the temperature of the cooling liquid 22, 22' circulated to the cooling passages 8,8' was 30° C. (X) and 80° C. (Y) as shown in FIG. 6. The results of the experiments, as shown in FIG. 6, found that the diameter of the casting roll can be varied by changing the temperature of the cooling liquid in the vicinity of the edges of the casting rolls 2,2' to provide a desired temperature profile across the cast strip.

Figure 7:
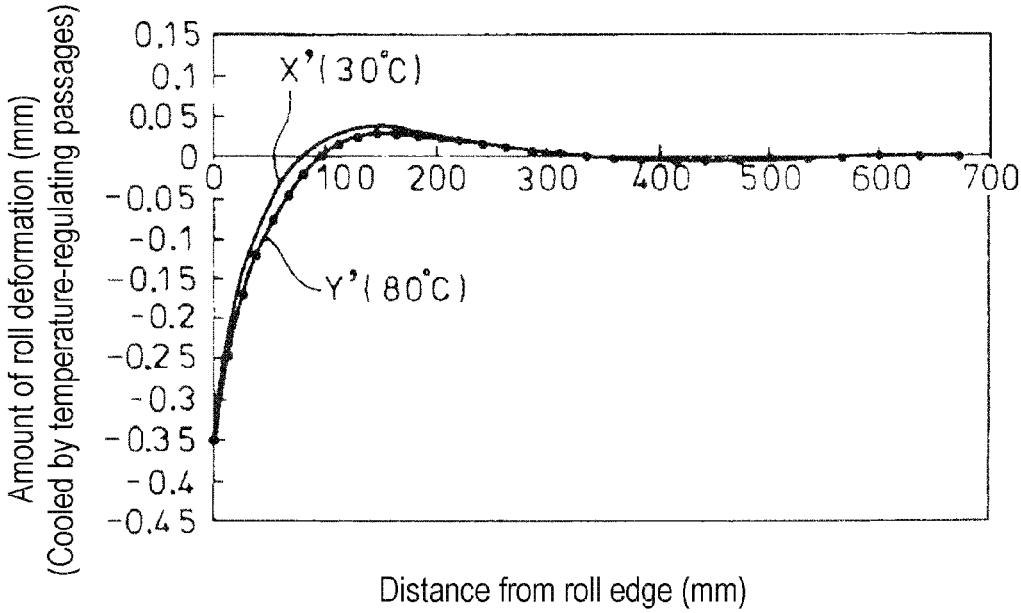
FIG. 7 is a graph showing the amount of deformation of a casting roll cooled by the temperature-regulating medium circulated through the temperature-regulating passages.

We also conducted experiments to determine the amount of radial deformation in the casting rolls 2 with distance from the casting roll edge with variation in the temperature of the temperature-regulating medium 26,26'. The temperature of the temperature-regulating medium 26,26', that was circulated to the temperature-regulating passages 9,9', which was circumferentially spaced inward from the cooling passages 8,8' in the casting rolls 2,2', was 30° C. (X') and 80° C. (Y') as shown in FIG. 7. The results of the experiments show that, when the casting rolls 2 were cooled by means of circulating the temperature-regulating medium 26,26' through the temperature-regulating passages 9,9', the amount of change in the casting rolls 2,2' was larger compared to the amount of change in the casting rolls 2,2' when cooled by circulating cooling liquid 22,22' through the cooling passages 8,8' as shown in FIG. 6. Furthermore the results show that the diameters of the cooling rolls 2,2' at the end portions were larger (i.e., the amounts of crown increased) as shown by X' when the temperature of the temperature-regulating medium 26 was low (30° C.), compared to when the temperature was high (80° C.) as shown by Y'.

Figure 8:
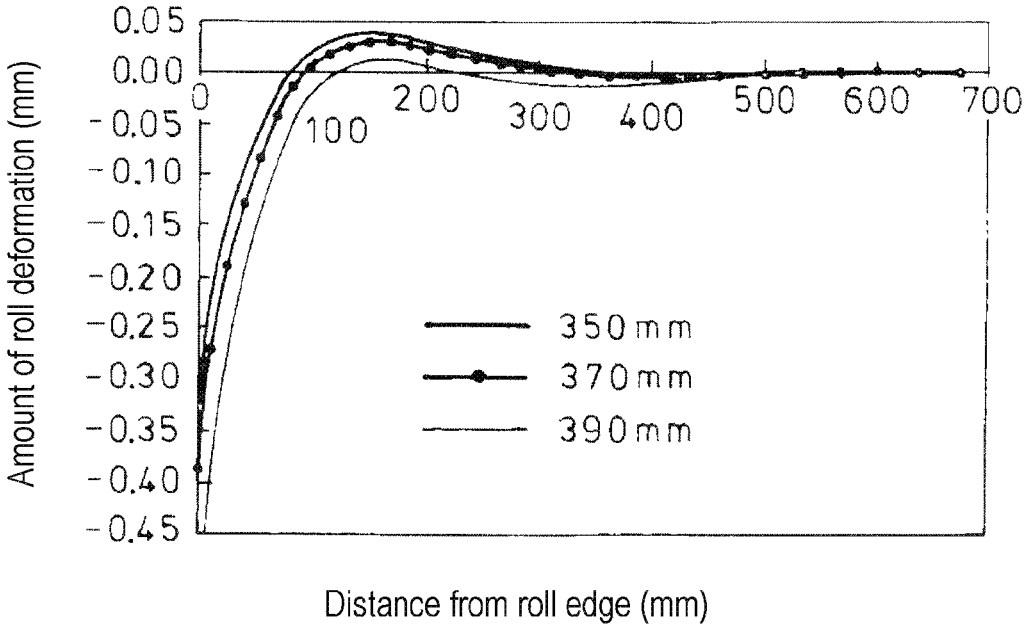
FIG. 8 is a graph showing the amount of deformation of a casting roll when the inner diameter of the circumferential portions of the casting rolls is varied.

Furthermore, we conducted experiments to determine the amount of deformation in the radial direction in the casting rolls 2,2' when the outer diameter of the casting rolls was 500 mm and the inner diameters of the circumferential portions 40 (copper sleeves 7) were provided with temperature-regulating passages 9,9'. The thickness of wall between the inner surface of the circumferential portions 40 and the temperature-regulating passages 9,9' was varied as shown in FIG. 8. The inner diameters of the circumferential portions 40 during the experiments were 350 mm, 370 mm and 390 mm. The results of the experiments, as shown in FIG. 8, show that, when the inner diameter of the circumferential portions 40 was high and the wall thickness was small, the roll crowns in the casting rolls 2,2' were small, and when the inner diameter of the circumferential portions 40 was low and the wall thickness was large, the roll crowns in the casting rolls 2,2' were large. This experiment showed increasing the wall thickness provided for a greater amount of change in the contour of the casting rolls 2,2'.

Overall, the experiments show that large amounts of change in the contours of the casting rolls 2,2' can be more effectively controlled by having temperature-regulating passages 9.9' in the casting rolls near the insides of the circumferential portions 40, when wall thickness between temperature-regulated passages 9 and the inner portions of the circumferential portions 40 of the casting roll 2,2' is at least as thick of the wall thickness between cooling passages 8,8' and the outer portions of circumferential portions 40 of the casting roll.

In order to cast thin cast strip 4 using the twin roll continuous caster 1, the casting surface 48 of the casting rolls 2,2' may be machined to, for example, the desired negative crowns according to the casting roll contour corresponding to the desired profile of the thin cast strip 4 to be cast. Before casting, the relationship between the amount of deformation of the casting rolls 2,2' and the temperature of the temperature-regulating medium 26 circulated to the temperature-regulating passages 9,9', as shown in FIG. 7, is calibrated, and input into the controller 30. At the same time, the cooling liquid 22 to be circulated through the cooling passages 8 to maintain the casting rolls 2,2' at a safe temperature is determined.

During the casting of the thin cast strip 4, the input to the controller 30 are the output signal 34 from the profile detector 33 (corresponding to the measured profile of the thin cast strip 4), and the output signal 32 from the thermometer 31 (corresponding to a measured temperature of the temperature-regulating medium 26,26' exiting the temperature-regulating passages 9,9' through outlets 14,14'), and the target profile value 35 of the thin cast strip. As shown in FIG. 5, the controller 30 is adapted to compare the target crown value 35*b* and the measured crown value 34*b*, and minimize the difference by changes in the temperature of the temperature-regulated medium 26,26' circulated through the temperature-regulated passages 9,9'. The controller 30 is adapted to control the temperature-regulating unit 28 which in turn controls the temperature of the temperature-regulating medium 26,26', and is the basic control of the relationship between the amount of deformation of the casting rolls 2,2' and the temperature of the temperature-regulating medium 26,26' as shown in FIG. 7.

As described above, consistent control of the contour of the casting rolls 2,2' can be achieved by controlling the temperature of the temperature-regulating medium 26,26' in accordance with the relationship, shown in FIG. 7. We have found regulation of the temperature of the temperature-regulating medium 26,26' that is circulated through the temperature-regulating passages 9,9' has a major effect on the contour of the casting rolls 2,2'.

Figure 9:
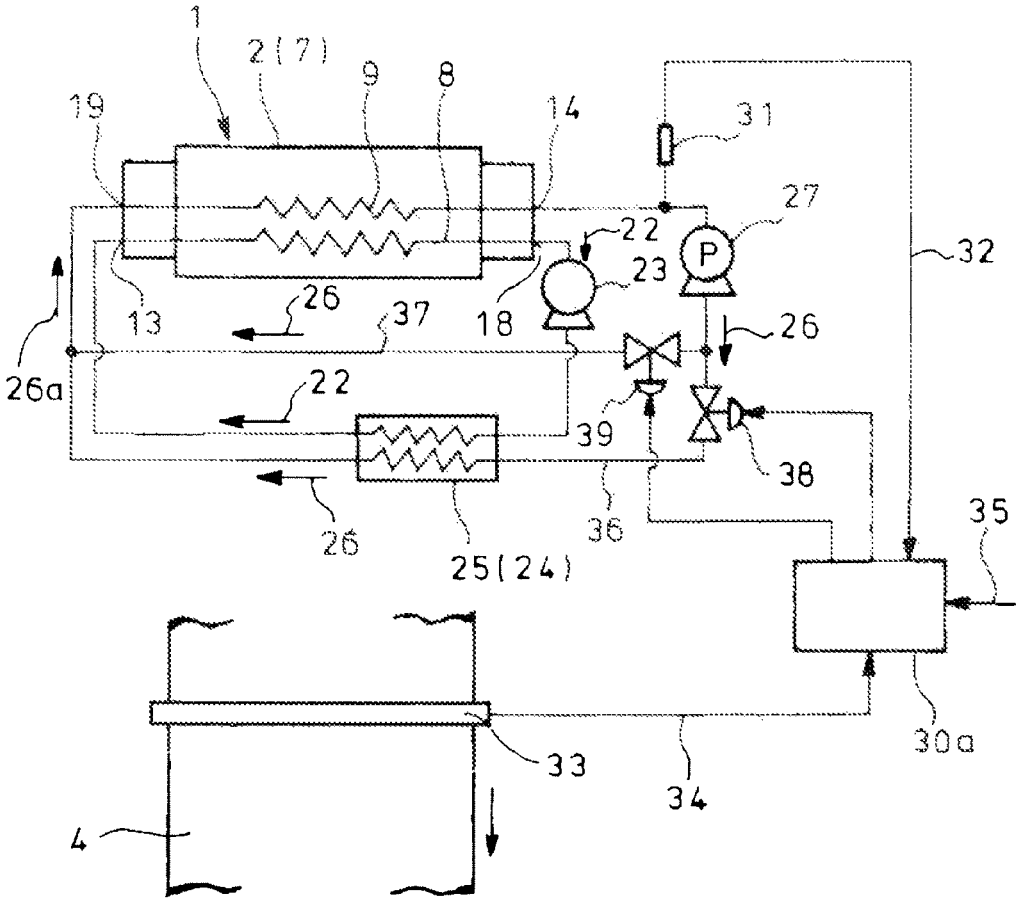
FIG. 9 is a block diagram showing an example of a twin roll continuous caster system with flow-rate regulated liquid medium circuits.

FIG. 9 is a block diagram showing an example of a twin roll continuous caster 1 with flow-regulated circuits including the cooling passages 8 and the temperature-regulating passages 9, respectively. The cooling liquid 22 that is discharged from the outlets 18 of the circumferential cooling passages 8 is circulated to and cooled by the cooler 25 (including cooling tower 24) adapted to cool the cooling liquid 22. The cooled cooling liquid 22 may then be circulated through the inlets 22 into the cooling passages 8 and cycled through the cooling passages 8 in a manner to cool the casting rolls 2 to a safe temperature during a casting campaign. A similar circulation of cooling liquid 22' may be provided circulating through cooling passages 8'.

Also as shown in FIG. 9, a portion of the temperature-regulating medium 26 discharged from the outlets 14 of the circumferential temperature-regulating passages 9, is circulated by pump 27 through the first temperature-regulating circulation circuit 36 to the cooler 25, and adapted to cool both the cooling liquid 22 and the temperature regulating medium 26. The temperature-regulating medium 26 is then circulated to the inlets 19 of the temperature-regulating passages 9. Furthermore, a portion of the temperature-regulating medium 26 is circulated to the second temperature-regulating circulation circuit 37 by the pump 27, and mixed with the temperature-regulating medium 26, circulated from the cooler 25 through the first temperature-regulating circulation circuit 36, regulating the temperature of temperature-regulating medium 26*a* which is circulated to the inlets 19. A similar circulation of temperature-regulating medium 26' is provided through temperature-regulating passages 9'.

Further, flow-rate regulation valves 38 and 39 are adapted to adjust the flow rate of the high temperature temperature-regulating medium 26 that flows through the first temperature-regulating circulation circuit 36 and the temperature-regulating medium 26 that flows through the second temperature-regulating circulation circuit 37, respectively. Controller 30*a* (similar to the controller 30) is adapted to control the degree of opening of the flow-rate regulation valves 38 and 39, thereby regulating the proportions of the temperature-regulating medium 26 from the first temperature-regulating circulation passage 36 and the temperature-regulating medium 26 from the second temperature-regulating circulation passage 37 that is mixed and enters the temperature-regulating passages 9 through inlets 19. Controller 30*a* may be separate from or may be part of controller 30. A similar circulation of temperature-regulating medium 26' is provided through temperature-regulating passages 9'.

Figure 10:
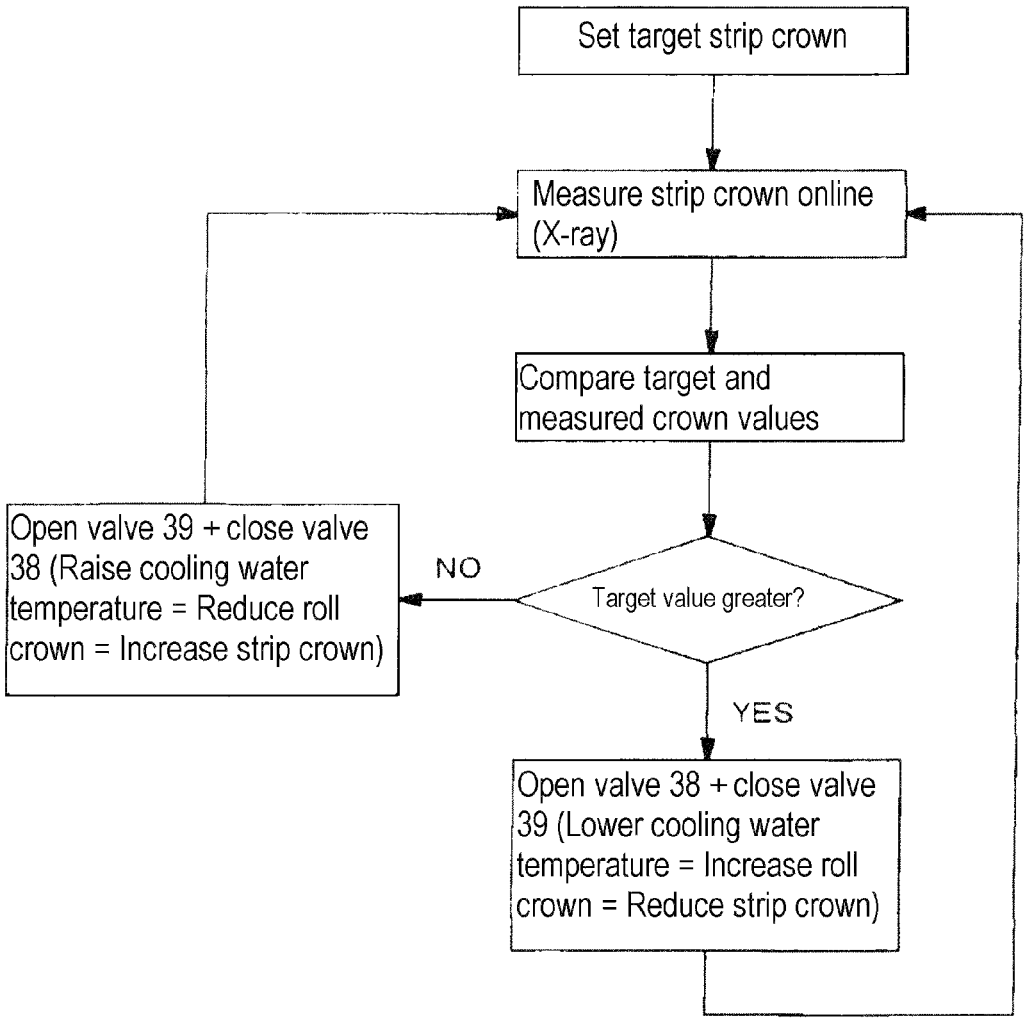
FIG. 10 is a flowchart showing an example of the contour control of the twin roll continuous caster system of FIG. 9.

The profile detection value 34 of the thin cast strip 4, measured by profile detector 33, temperature 32 measured by the thermometer 31, and the target contour value 35 are input to the controller 30*a*, so that the controller 30*a* is adapted to control the flow rates of temperature-regulating medium 26,26' according to the flow chart shown in FIG. 10. The profile detection value 34 and the target contour value 35 are based on the relationship between the amount of deformation of the casting rolls 2,2' and the temperature of the temperature-regulating medium 26,26' flowing through temperature-regulating passages 9,9' (measured at the outlets) as shown in FIG. 7.

As demonstrated by FIG. 10, if the measured crown value 34*b* is greater than the target crown value 35*b*, the controller 30*a* operably opens the flow-rate regulation valve 38 to increase the flow through it, and operably closes the flow-rate regulation valve 39 to reduce the flow through it. The degree of opening of the valves is adjusted to reduce the temperature of the temperature-regulating medium 26,26' that is circulated to the temperature-regulating passages 9,9'. The roll crowns of the casting rolls 2,2' are thus increased as shown in FIG. 7, and the strip crown of the thin cast strip 4 is reduced.

Conversely, if the measured crown value 34*b* is lower than the target crown value 35*b*, the controller 30*a* operably opens the flow rate regulation valve 39 to increase the flow through it, and operably closes the flow rate regulation valve 38 to decrease the flow through it. The degree of opening of the valve increases the temperature of the temperature-regulating medium 26,26' that is circulated to the temperature-regulating passages 9,9'. The roll crowns of the casting rolls 2,2' are thus reduced as shown in FIG. 7, and the strip crown of the thin cast strip 4 is increased, thereby controlling the profile of the thin cast strip 4.

By adjusting these parameters, control is exercised that alters the contours of the casting rolls 2,2' by controlling the temperature of temperature-regulating medium 26,26' circulated to the circumferential temperature-regulating passages 9,9', which are spaced inward of the cooling passages 8,8' of the circumferential portions 7. It is possible to control large amounts of change to the contours of the casting rolls 2,2' with good accuracy, and improve in the yield and profile quality of the thin cast strip 4 that is cast by the disclosed twin roll continuous caster 1.

Figure 11:
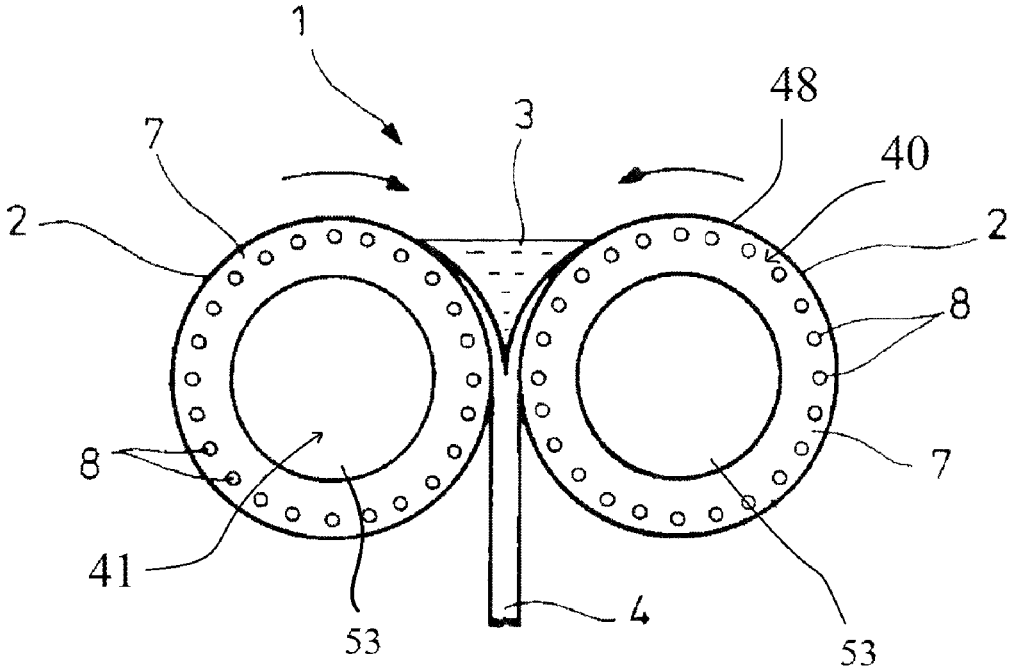
FIG. 11 is a front cross-sectional view of the twin roll continuous caster, with the inner portion of the casting rolls adapted to transport a liquid medium.
Figure 12:
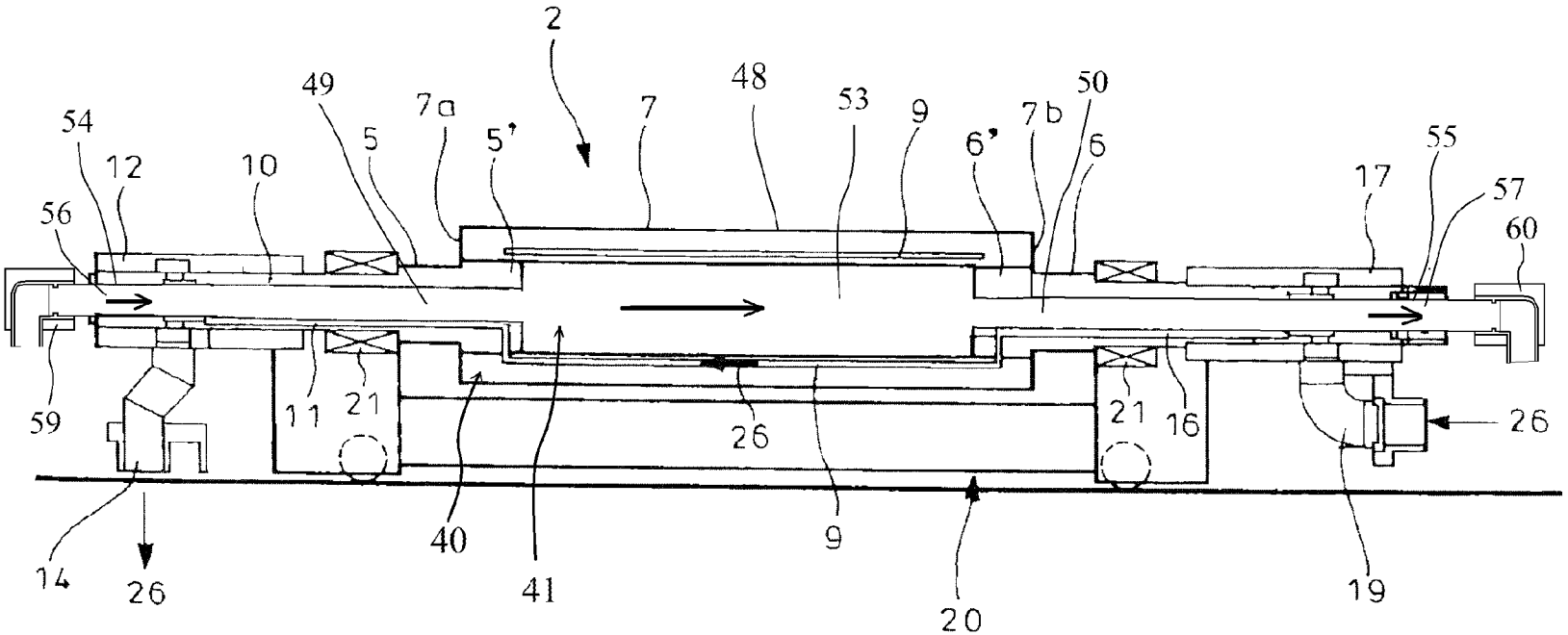
FIG. 12 is a front cross-sectional view of a twin roll continuous caster of FIG. 11, with the inner portion of the casting roll adapted to transport a liquid medium.
Figure 13:
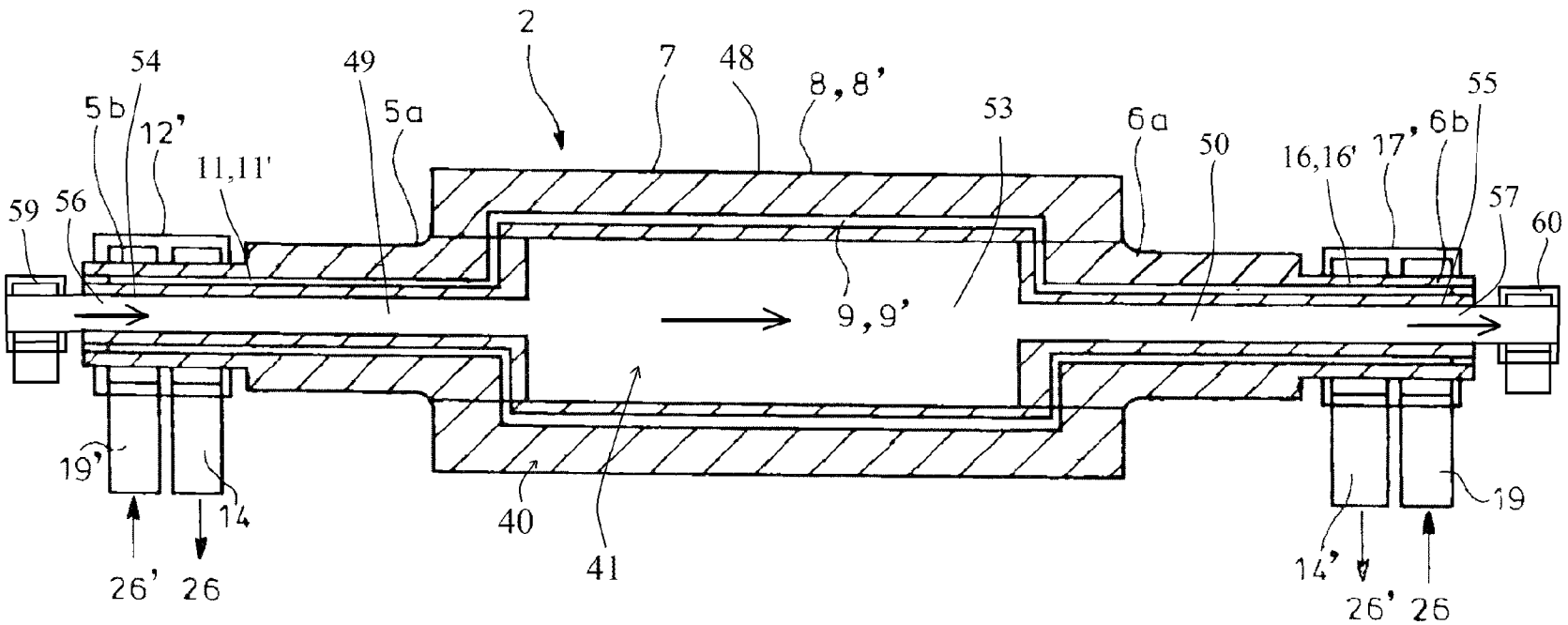
FIG. 13 is a front cross-sectional block diagram of the casting roll of FIG. 11.

FIGS. 11, 12 and 13 show an alternative embodiment of a twin roll continuous caster 1, where the inner portion 41 of the casting roll 2 comprises the temperature-regulating passages. A single passage 53 may be provided for circulation of temperature-regulating medium 58 through the casting roll 2 to regulate the temperature and in turn the deformation of the casting roll 2. The temperature-regulating medium may typically be water. The passage 53 having a first end portion 54 with an inlet 56 and a second end portion 55 with an outlet 57. In this embodiment, as shown in FIGS. 11, 12 and 13, single passage 53 may be provided in the casting rolls 2 and 2'. The embodiment illustrated in FIG. 11 shows a casting roll 2 having an inner portion 41 and an outer circumferential portion 40, the outer circumferential portion 40 comprising cooling passages 8. The embodiment illustrated in FIGS. 12, and 13, show a casting roll 2 having an inner portion 41 and an outer circumferential portion 40, the outer circumferential portion 40 comprising temperature-regulating passages 9 and 9'. In addition to the temperature-regulating medium carried by the single passage 53, if temperature-regulating medium is also desired in the outer circumferential portion 40, casting rolls 2 and 2' may have the same or different temperature-regulation medium circulated through temperature-regulation passages 9 in the outer circumferential portion 40.

In any case, the inlet 56 and outlet 57 on inner portion 41 may be connected through a first temperature-regulating circuit, circulating temperature-regulated medium from the outlet 57 through rotary joint 60 to a temperature-regulated medium supply unit and from the temperature-regulated medium supply unit to the inlet 56 through rotary joint 59. In addition, the inlet 56 and outlet 57 may be connected through a second temperature-regulating circuit adapted to direct liquid medium from the outlet 57 to the inlet 56. The first and second temperature-regulated circuit include one or more pumps to circulate temperature-regulated medium through the supply unit and the passage 53 in the inner portion 41 of the casting roll 2. A controller may be provided to regulate the flow rate between the first and second temperature-regulating circuits. The controller, which may be separate from or in addition to controller 30 may also be adapted to regulate the temperature of the temperature-regulated medium flowing through passage 53, as well as the cooling liquid flowing through the cooling passages 8 in the outer circumferential portions 40 of the casting rolls 2 and 2'.

One of ordinary skill in the art will appreciate and recognize that the embodiments herein described for cooling the casting rolls through the inner and outer circumferential portions of the casting rolls are not exhaustive and there are many ways of cooling the inner and outer circumferential portions of the casting rolls which are encompassed within the spirit of the present invention.

The generality of the twin roll continuous caster envisaged by the present invention is not limited to the particular embodiments thereof described above, and various modifications thereto may of course be added provided within the scope of the following claims.

The invention claimed is:

1. A twin roll continuous caster comprising:

a pair of casting rolls having a first end portion and a second end portion laterally positioned to form a nip adapted to support a molten casting pool formed therebetween and to cast a thin strip cast downwardly from between the casting rolls;

the casting rolls comprising circumferential portions having a plurality of circumferential cooling passages, each having a first end portion and a second end portion, adjacent a circumferential casting surface, and a temperature-regulating passage or passages spaced inward of the cooling passages with each having a first end portion adjacent the casting roll first end portion and a second end portion adjacent the casting roll second end portion and extending between said first end portion and said second end portion of the temperature-regulating passage or passages through the casting rolls;

a cooler adapted to cool cooling liquid supplied to the cooling passages through inlets at the first end portions;

a temperature-regulating medium supply unit; and a temperature-regulated temperature-regulating medium adapted to enter inlets at the first end portions of said temperature-regulating passages from the temperature-regulating medium supply unit and adapted to discharge the temperature-regulating medium through outlets at the second end portions of the temperature-regulating passages.

2. The twin roll continuous caster as claimed in claim 1, where a plurality of circumferential temperature-regulating passages are spaced inward of the cooling passages in the casting rolls.

3. The twin roll continuous caster as claimed in claim 1, where a singular circumferential temperature-regulating passage is spaced inward of the cooling passages through the central portion of the casting rolls.

4. The twin roll continuous caster as claimed in claim 1, where the temperature-regulating medium supply unit further comprises a temperature regulator adapted to regulate the temperature of the temperature-regulating medium circulating through the temperature-regulating passages.

5. The twin roll continuous caster as claimed in claim 4, where the temperature regulator is a cooling water tower.

6. The twin roll continuous caster as claimed in claim 4, further comprising:

a thermometer adapted to detect the temperature of the temperature regulating medium discharged from the outlets at the second end portion of the temperature-regulating passages and to produce an output signal corresponding to the measured temperature of the temperature-regulating medium;

a profile detector adapted to detect a measured profile of the thin strip and produce an output signal corresponding to the measured profile of the thin cast strip; and, a controller adapted to receive the output signal from the thermometer, the output signal from the profile detector and a target profile value of the thin strip, and to regulate the temperature of the temperature-regulating medium by the temperature regulator to produce thin cast strip of a desired profile.

7. The twin roll continuous caster as claimed in claim 5, further comprising:

a thermometer adapted to detect the temperature of the temperature regulating medium discharged from the outlets at the second end portion of the temperature-regulating passages and to produce an output signal corresponding to the measured temperature of the temperature regulating medium;

a profile detector adapted to detect a measured profile of the thin strip and produce an output signal corresponding to the measured profile of the thin cast strip; and, a controller adapted to receive the output signal from the thermometer, the output signal from the profile detector and a target profile value of the thin strip, and to regulate the temperature of the temperature-regulating medium by the temperature regulator to produce thin cast strip of a desired profile.

8. The twin roll continuous caster as claimed in claim 1, where the temperature-regulating medium supply unit comprises:

a first temperature-regulating circuit in which the temperature-regulating medium discharged from the outlets at the second end portion of said temperature-regulating passages is directed to the cooler for cooling and then directed from the cooler to the inlets at the first end portion of said temperature-regulating passages;

a second temperature-regulating circuit adapted to direct liquid with elevated temperature discharged from the outlets at the second end portion of the temperature-regulating passages directly to said inlets at the first end portion of the temperature-regulating passages; and, a flow rate regulator adapted to regulate the temperature of the casting roll by regulating flow rate distributions of the liquid between said first and second temperature-regulating circuits.

9. The twin roll continuous caster as claimed in claim 8, where the temperature regulator is a cooling water tower.

10. The twin roll continuous caster as claimed in claim 8, further comprising:

a thermometer adapted to detect the temperature of the temperature-regulating medium discharged from the outlets at the second end portion of the temperature-regulating passages and produce an output signal corresponding to the detected temperature;

a profile detector adapted to detect the profile of the thin strip and produce an output signal corresponding to the detected profile;

a controller adapted to receive as inputs the output signals from the thermometer and the profile detector and a target profile value of the thin strip, and to regulate the temperature of the temperature-regulating medium being supplied to the temperature-regulating passages by the flow rate regulator to produce thin cast strip of a desired profile.

11. The twin roll continuous caster as claimed in claim 9, further comprising:

a thermometer adapted to detect the temperature of the temperature-regulating medium discharged from the outlets at the second end portion of the temperature-regulating passages and produce an output signal corresponding to the detected temperature;

a profile detector adapted to detect the profile of the thin cast strip and to produce an output signal corresponding to the detected profile;

a controller adapted to receive as inputs the output signals from the thermometer and the profile detector and receive an input corresponding to a target profile value of the thin strip, and to regulate the temperature of the temperature-regulating medium by the flow rate regulator to produce thin cast strip of a desired profile.

12. The twin roll continuous caster of claim 1 where the inner portions of the casting rolls are adapted to transport temperature-regulating medium through the casting roll.

13. A twin roll continuous caster comprising:

a pair of laterally positioned casting rolls each having a first end and a second end forming a nip therebetween, adapted to support a casting pool of molten metal above the nip, the casting rolls adapted to counter-rotate to form thin strip cast downwardly from the nip;

the casting rolls having an inner portion and an outer circumferential portion;

the outer circumferential portion having at least one set of passages circumferentially positioned in the casting roll adjacent the casting surfaces adapted to transport liquid cooling liquid ; and, the inner portion of the casting rolls comprising a passage or passages adapted to carry a temperature-regulating medium extending between adjacent the first end of the casting rolls and adjacent the second end of the casting rolls wherein the passage or passages is/are located within the casting rolls.

14. The twin roll continuous caster of claim 13, where the inner portion of the casting rolls further comprises a plurality of passages adapted to carry a temperature-regulating medium.

15. The twin roll continuous caster of claim 13, where the inner portion comprises a single passage adapted to carry a medium adapted to cool the casting roll.

* * * * *